US005596902A

United States Patent [19]

McMillen

[11] Patent Number: 5,596,902

[45] Date of Patent: Jan. 28, 1997

[54] STARTER DRIVE CLUTCH

[75] Inventor: Bobby E. McMillen, Columbus, Miss.

[73] Assignee: United Technologies Motor Systems, Inc., Dearborn, Mich.

[21] Appl. No.: 339,941

[22] Filed: Nov. 15, 1994

[51] Int. Cl.[6] ..... F02N 15/06

[52] U.S. Cl. ..... 74/7 C; 74/7 R; 464/46

[58] Field of Search ..... 464/46, 30, 40, 464/45; 192/56.55; 74/7 R, 7 C

[56] References Cited

U.S. PATENT DOCUMENTS

| | | | |
|---|---|---|---|
| 2,226,222 | 12/1940 | Hodges | 74/7 C |
| 2,644,338 | 7/1953 | Miller | 74/7 C |
| 2,787,910 | 4/1957 | Sabatini | 74/7 |
| 2,845,054 | 7/1958 | Palfreyman et al. | 74/7 C |
| 3,090,242 | 5/1963 | Sabatini | 74/7 |
| 3,306,409 | 2/1967 | Giometti | 192/104 |
| 3,396,557 | 8/1968 | Moores, Jr. | 464/46 |
| 3,458,019 | 7/1969 | Fant et al. | 192/42 |
| 4,308,462 | 12/1981 | McMillen | 290/38 R |
| 4,325,265 | 4/1982 | Wakatsuki et al. | 74/7 R |
| 4,542,812 | 9/1985 | Westley | 464/46 |
| 4,785,679 | 11/1988 | Weber et al. | 74/7 R |
| 4,883,152 | 11/1989 | Froment | 74/7 C |
| 4,895,234 | 1/1990 | Fujino | 192/42 |
| 5,081,385 | 1/1992 | Gajjar | 464/46 |
| 5,180,042 | 1/1993 | Ogiso | 464/46 |
| 5,241,871 | 9/1993 | McKnight, III et al. | 464/46 |

*Primary Examiner*—Charles A. Marmor
*Assistant Examiner*—David Fenstermacher
*Attorney, Agent, or Firm*—Donald R. Fraser

[57] ABSTRACT

An engine starter drive clutch assembly which comprises a starter motor with an armature shaft, pinion gear for engaging and disengaging an engine drive gear, a spline for transmitting axial rotational movement to the pinion gear, and a clutch assembly for transmitting torque between the armature shaft and the pinion gear.

1 Claim, 1 Drawing Sheet

STARTER DRIVE CLUTCH

BACKGROUND OF THE INVENTION

The present invention relates to a clutch assembly and method for limiting torque transmission particularly applicable in an electrically energized starter for an internal combustion engine.

Electric starter motors are widely utilized for cranking small gasoline engines such as those utilized in garden tractors, lawn mowers, snow blowers, outboard motors for boats and the like. In such a starter, a pinion drive provides the means for momentarily engaging the engine flywheel to transfer power from the electric starting motor to the internal combustion engine and then disengaging the starter motor from the flywheel once the engine has started to prevent damage to the starter motor. The most common way to facilitate engagement and disengagement of the pinion with the flywheel is to mount the pinion gear to a shaft so that it is rotatably driven by the motor and is simultaneously moved axially along the shaft. The axial movement allows full engagement of the pinion gear with the flywheel during cranking and complete disengagement once the engine has started. The axial travel of the pinion gear is generally facilitated by one of two means. The pinion gear is either forced along the shaft by a solenoid or by inertia of the pinion gear interacting with the accelerating motor shaft by means of mating helical threads on the pinion gear and the associated shaft.

Exemplary starter assemblies are illustrated and described in U.S. Pat. Nos. 3,690,188 and 4,255,982.

In a typical starter assembly, the flywheel of the associated internal combustion engine has gear teeth formed about the outer periphery thereof and a spring biased pinion gear adapted to selectively drivingly engage the flywheel gear teeth is coupled to the output shaft of a starting motor through a torque limiting friction clutch and a helical spline.

When the starting motor is energized and commences to rotatingly drive the output shaft, the inertia of the pinion gear resists rotation and the helical spline causes the pinion gear to translate axially along the starting motor output shaft and thence into engagement with the gear teeth of the flywheel.

The engine is then cranked until the speed of the engine surpasses the speed at which it is driven by the starting motor. When the engine speed surpasses the starting motor speed, the helical spline causes the pinion gear to disengage from the flywheel gear teeth. Simultaneously, an associated anti-drift helical spring urges the pinion gear out of engagement and toward its normal rest position.

It is readily apparent that during the starting of an internal combustion engine, the starting motor including the associated pinion, is subjected to considerable shock and loading stresses as it initially engages and disengages from the flywheel gear teeth of the engine.

Such stresses are inherent as the starting motor armature and pinion are rotating as the pinion gear engages the relatively large mass of the engine flywheel and associated engine components which are at rest.

An ever present problem encountered in the design of an electric starting motor for cranking internal combustion engines is providing the starting motor components with means to absorb or decrease the torsional shock when the pinion gear of the starting motor initially engages the flywheel gear teeth of the associated engine. At the time of the engagement, the armature, drive shaft, and pinion are rotating at a relatively high speed and the flywheel of the engine is not rotating. The moment the pinion gear of the starting motor engages the flywheel gear teeth, a sudden torsional shock is imparted to the flywheel as well as to the starting motor pinion gear and associated armature. The resultant torsional shock may result in damage to either the starting motor or the flywheel, or both.

Various schemes over the years have been developed in an attempt to solve or minimize the problem. Some attempts have been directed to mechanisms to soften or decrease the torsional shock upon engagement, while other attempts have utilized a slip-clutch of some configuration.

SUMMARY OF THE INVENTION

It is an objective of the present invention to produce a slip-clutch arrangement that is very effective, simple in design and economical to manufacture.

Another objective of the invention is to produce a clutch mechanism for a starting motor for an internal combustion engine which contains components which may be highly automatable from a production standpoint.

Another object of the invention is to produce a clutch assembly for a starting motor for an internal combustion engine provided with a predetermined amount of slip torque to prevent damage to the associated components.

Still another object of the invention is to produce a slip clutch for a starting motor for starting an internal combustion engine which will limit the maximum torque transfer between the starting motor and the associated internal combustion engines.

The above as well as other objects of the invention may typically be achieved by an electric motor having a rotatable shaft; a pinion gear mounted for driving a flywheel of an engine; and a clutch assembly for transmitting torque between the shaft of the motor and the pinion gear, the clutch assembly comprising a driving member coupled to the shaft of the motor for rotational movement, a spline rotatingly mounted to the shaft of the motor for slight axial movement relative to the shaft, and a housing for coupling the driving member and the spline for fictionally transmitting torque between the driving member and the spline.

BRIEF DESCRIPTION OF THE DRAWINGS

The above as well as other objects and advantages of the invention will become readily manifest to one skilled in the art from reading the following detailed description of the preferred embodiment of the invention when considered in the light of the attached drawings, in which.

DETAILED DESCRIPTION OF THE PREFERRED EMBODIMENT

Figure 1:
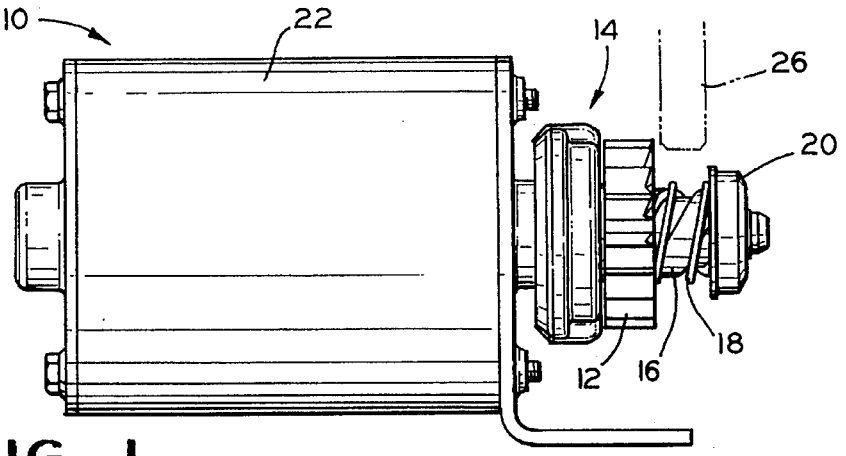
FIG. 1 is an elevational view of an engine starter assembly embodying the features of the present invention.

Referring to the drawings, there is illustrated an engine starter motor 10, a pinion gear 12, a friction clutch 14, a spline 16 extending from the clutch assembly 14, an anti-drift spring 18, and a retainer 20.

The motor 10 is a conventional starter motor having a housing 22 and an armature shaft 24 extending outwardly from the housing 22. The pinion gear 12 is journalled on the spline 16 which, in turn, is journalled on the armature shaft 24. The pinion gear 12 is adapted for rotational movement and axial displacement along the pinion gear 12 to engage and disengage with a flywheel 26 of an associated internal combustion engine.

The clutch assembly 14 includes the spline 16 provided with an external helical thread 30 adapted to threadably engage with internal threads 32 of the pinion gear 12. The assembly 14 further includes a housing cover 34 having an aperture in the side wall thereof through which the threaded portion 30 of the spline 16 is adapted to extend. Also, the spline 16 is provided with a flanged portion 36, one surface of which is adapted to seat against the inner surface of the housing wall through which the threaded portion 30 of the spline extends.

Within the housing 34, adjacent the opposite side of the flange 36 of the spline 16, is a clutch washer 38. The clutch washer 38 has diametrically opposed outwardly extending tabs 40 which are caged within diametrically opposed channels 42 formed in the housing 34.

Next, a wave washer 48 is disposed to reside adjacent the side of the clutch washer 38 opposite that facing the flange 36 of the spline 16.

A base plate 50 having diametrically opposed outwardly extending tabs 52 is positioned within the housing 34 such that the tabs 52 are received within the channels 42.

Finally, the peripheral marginal edges of the housing 34 are crimped over the base plate 50. During the final crimping operation, the base plate 50 is forced inwardly of the housing 34 until the plate bottoms on a shoulder 54 formed in housing 34 at which time the wave washer will be sufficiently compressed. Thus, pressure is provided between the base plate 50, the wave washer 48, the clutch washer 38, the flange 36 of the spline 16, and the inner wall of the housing 34.

Figure 2:
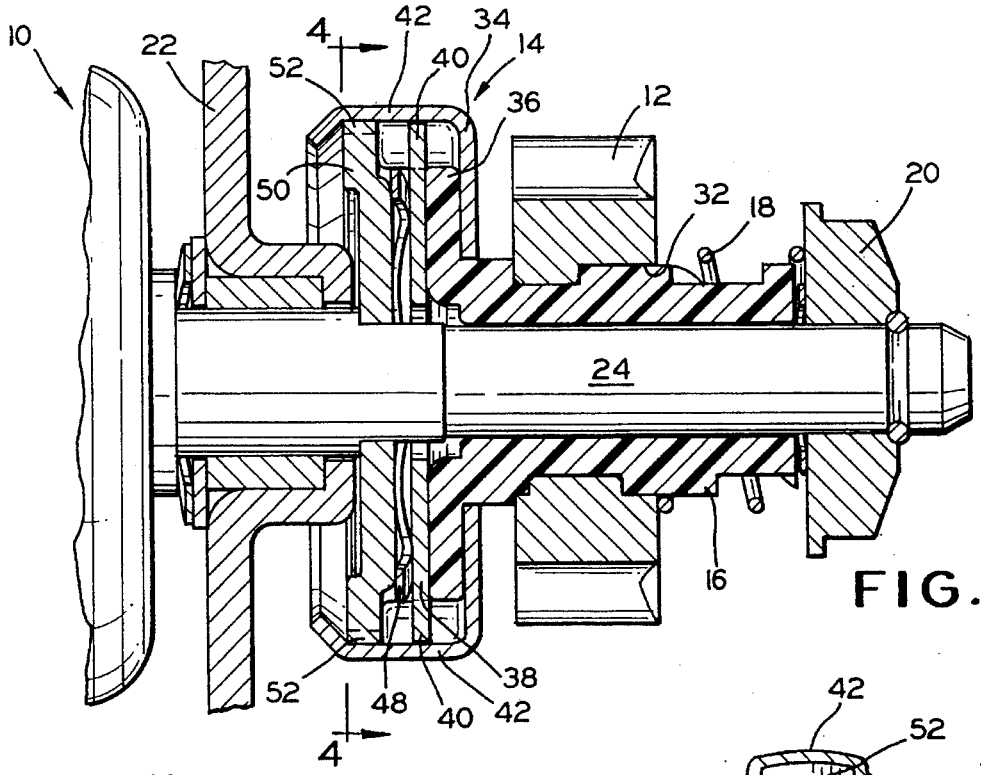
FIG. 2 is an enlarged sectional view of the clutch assembly of the starter assembly illustrated in FIG. 1.
Figure 3:
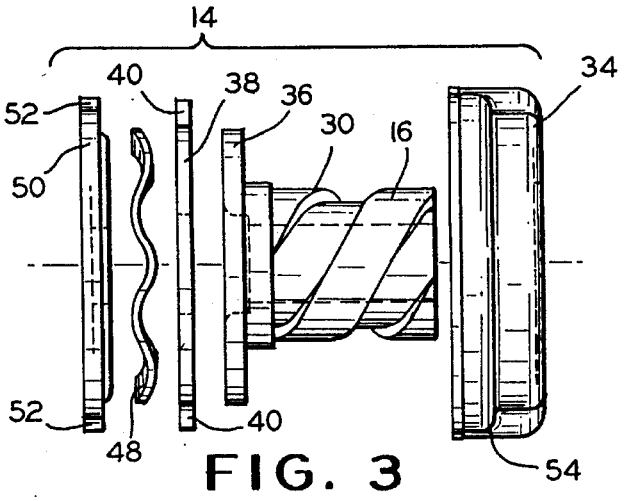
FIG. 3 is an exploded view of the clutch assembly illustrated in FIG. 2.
Figure 4:
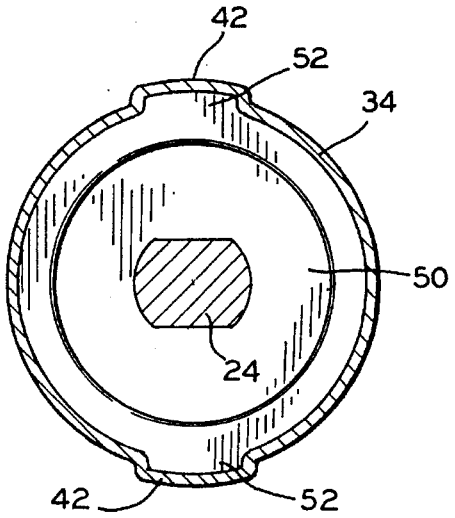
FIG. 4 is a sectional view taken along line 4—4 of FIG. 2.

The base plate 50 is provided with a double "D" hole which mates with a corresponding outer configuration of the shaft 24 of the starter motor as clearly illustrated in FIGS. 2 and 4. Accordingly, the base plate 50 is, in effect, keyed to and is therefore driven by the shaft 24.

The wave washer 48, the clutch washer 38, and the spline 16 are each provided with openings that are larger than the outer diameter of the shaft 24 and, therefore, tend to "float" freely on the shaft 24. More specifically, since the clutch assembly 14 is housed within the housing 34 which is maintained, in effect, coaxially of the shaft 24 by the base plate 50, the wave washer 48, the clutch washer 38, and inner bore of the spline 16 are maintained in axial relation with the shaft 24.

In operation, it will be appreciated that the armature shaft 24 drives the base plate 50 which, in turn, drives the spline 16 upon which the pinion gear 12 is keyed via the spline or threads 30. The pinion gear 12 is free to rotate on the spline 16. Any relative rotational movement between the pinion gear 12 and the spline 16 results in axial movement of the pinion gear 12. As the starter motor 10 is energized, the fast acceleration of the clutch assembly acting with the inertia of the pinion gear 12 causes the pinion gear 12 to move outwardly along the longitudinal axis of the spline 16 until engagement with the flywheel ring gear 26 of the associated engine which is to be started.

Upon initial engagement with the stationary flywheel, the sudden loading will result in a slippage in the clutch assembly 14. As the back loading on the spline 16 occurs due to loading, the wave washer 48 will be caused to become even more compressed. Thus, enough precalculated pressure in addition to the back loading pressure will start the engine flywheel to rotate and will continue causing the flywheel to rotate until the engine starts. When the engine starts, the pinion gear 12 will back away from the flywheel 26 and come to rest in the normal "at rest" position, which necessarily is free and clear of engagement with the flywheel gear teeth 26. The anti-drift spring 18 militates against drifting movement of the pinion gear 12 caused by engine vibration and thereby prevents contact between the pinion gear 12 and the associated rotating ring gear 26.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. An electric starter for an internal combustion engine comprising:

an electric motor having a rotatable armature shaft;

a pinion gear mounted for selectively driving a flywheel of an engine; and a clutch assembly for transmitting torque between the shaft of said motor and said pinion gear, said clutch assembly comprising:

a driving member including a base plate drivingly coupled to the shaft of said motor for rotational movement, a spline rotatingly mounted to the shaft of said motor for slight axial movement relative to the shaft, and a housing interlocking said driving member and said spline for fictionally transmitting torque between said driving member and said spline, wherein said housing is formed with diametrically opposed recesses and the base plate of said driving member is formed with radially extending tabs adapted to be received within the recesses of said housing.

* * * * *